US008997928B1

(12) United States Patent
Ellis

(10) Patent No.: US 8,997,928 B1
(45) Date of Patent: Apr. 7, 2015

(54) FALL RESTRAINT TRAVELER DEVICE

(71) Applicant: Morgan Todd Ellis, Alachua, FL (US)

(72) Inventor: Morgan Todd Ellis, Alachua, FL (US)

( * ) Notice: Subject to any disclaimer, the term of this patent is extended or adjusted under 35 U.S.C. 154(b) by 81 days.

(21) Appl. No.: 14/048,271

(22) Filed: Oct. 8, 2013

(51) Int. Cl.
*A62B 35/00* (2006.01)
*E06C 7/18* (2006.01)
*A62B 1/14* (2006.01)

(52) U.S. Cl.
CPC ..... *A62B 35/0081* (2013.01); *A62B 35/0037* (2013.01); *A62B 35/0075* (2013.01); *E06C 7/187* (2013.01); *A62B 1/14* (2013.01); *E06C 7/186* (2013.01)

(58) Field of Classification Search
CPC ..... E06C 7/186; E06C 7/187; A62B 1/14
See application file for complete search history.

(56) References Cited

U.S. PATENT DOCUMENTS 3,177,543 A * 4/1965 Fountain ..... 188/65.2
3,437,178 A * 4/1969 Postlethwait ..... 188/65.2
4,440,183 A 4/1984 Miller
2002/0104711 A1* 8/2002 Nichols ..... 182/192
2002/0117353 A1* 8/2002 Jones ..... 182/3
2010/0051381 A1* 3/2010 Wydner et al. ..... 182/5

FOREIGN PATENT DOCUMENTS

CA 2181858 A1 * 1/1998

OTHER PUBLICATIONS

Prusik Knot / Hitch; Wikipedia, last modified Jul. 16, 2012.

* cited by examiner

*Primary Examiner* — Alvin Chin-Shue
(74) *Attorney, Agent, or Firm* — David L. King

(57) ABSTRACT

The fall restraint traveler device has a hollow body structure, two or more spacers, one or more lanyards and a leash. The hollow body structure has a first end and a second end. A safety rope extends passing through both first and second ends. The body structure has an elongated slot extending between the ends. The two or more tubular spacers are placed internal of the body structure with the safety rope passing through each spacer. The one or more lanyards are for attachment to a climber. Each lanyard has at least one locking element. The device is aligned with and free to slide along the safety rope during ascent or descent of the climber and in the event of a fall, the at least one locking element tightens as it pulls on the safety rope pulling the rope out of alignment and thereby cinching to the rope.

14 Claims, 3 Drawing Sheets

FALL RESTRAINT TRAVELER DEVICE

TECHNICAL FIELD

This invention relates to a safety device for use with a rope to arrest the fall of a climber who may lose his or her foothold on a ladder or other climbing support structure.

BACKGROUND OF THE INVENTION

The use of safety ropes and harnesses for a person working on a perch or a platform is well known in the prior art. A more difficult challenge is to provide a fall safety device to arrest the fall of a person climbing a ladder.

Many safety and maintenance vehicles are equipped with vertically extendible devices to permit operation high above the ground. An example is an aerial ladder carried by a fire truck. These vertically extendible devices must be carefully supported and stabilized for the safety of persons using them. An aerial ladder on a fire truck, for example, is typically mounted on a rotatable base or platform which permits the ladder to be positioned at any point on a circular arc. The fire truck and ladder are stabilized by outriggers deployed outwardly on opposite sides of the truck. Such outriggers usually extend about five feet on each side of the fire truck and provide very good stabilization for any rotational position of the aerial ladder.

The platforms or aerial ladders typically are refracted in stacked sections onto a fire truck such that the length can be reduced while driving. The ladder can have three or more stacked sections that are laid on top of the others. As the ladder is set up vertically, these sections are driven upwardly extending the ladder. When full extended the ladder can reach 75 to 150 feet or more. The incline of the ladder typically is 60 degrees or more, often almost vertically oriented up to 75 degrees or so. The ladders have rungs onto which the firefighter places his or her feet to upwardly climb. The sides have handrails to help keep the firefighter from falling.

Often the firefighter is laden with heavy equipment while climbing and has much of this weight on his or her back. This magnifies the risk of losing balance and slipping. Once the start of a fall occurs, if the firefighter cannot catch oneself by grasping a rung or handrail, he or she is likely to fall. Too often this fall is fatal due to the extreme heights.

To prevent falling, the firefighter can tie himself or herself to the top of the extended ladder once he or she has climbed that far. Unfortunately, the falls often occur as the firefighter is climbing and to date there has been no way to safely secure the climbing firefighter without impeding his or her rapid ascent.

Another objective of the present device is to permit objects to be hoisted up or down a safety rope with a device that allows free movement along the safety rope, but locks up upon a weight exertion on the rope causing the device to cinch the rope.

It is therefore an object of the present invention to provide a safe and simple fall restraint device for use on such aerial ladders that secures the climbing firefighter while not interfering with the climb.

Another objective is to have the device employable with the extension of the ladder.

Another objective is to have the device not interfere with the setting up, extension or refraction of the ladder, but rather to coexist with the ladder and the climber without detrimentally getting in the way of or impeding the operation.

These and other objectives are achieved by the inventive fall restraint device described as follows.

SUMMARY OF THE INVENTION

A fall restraint traveler device for free-sliding attachment to a safety rope held taut between ends while affixed to a ladder or other climbing support structure like an extendable or telescoping ladder platform. The fall restraint traveler device has a hollow body structure, two or more spacers, one or more lanyards and a leash. The hollow body structure has a first end and a second end. The safety rope extends passing through both first and second ends, the body structure having an elongated slot extending between the ends. The two or more tubular spacers are placed internal of the body structure with the safety rope passing through each sleeve. The one or more lanyard is for attachment to a climber. Each lanyard has at least one locking element. Each locking element is spaced between a pair of spacers and wrapped about said rope. The one or more lanyards extend through the elongated slot to the climber. The leash is attached to the body structure. The leash is attached or held by the climber. The body structure with the sleeves and locking element are aligned with and free to slide along the safety rope during ascent or descent of the climber and in the event of a fall, the at least one locking element tightens and pulls on the safety rope pulling the rope out of alignment and thereby clinching to the rope.

The fall restraint traveler device of the preferred embodiment has two lanyards each having a locking element and also has three spacers. The one or more lanyards is a rope and the at least one locking element is a knot adapted to remain open until pulled. Preferably, the at least one locking element is a PRUSIK knot, more preferably the at least one locking element is a triple wrapped PRUSIK knot.

BRIEF DESCRIPTION OF THE DRAWINGS

The invention will be described by way of example and with reference to the accompanying drawings in which.

DETAILED DESCRIPTION OF THE INVENTION

Figure 1:
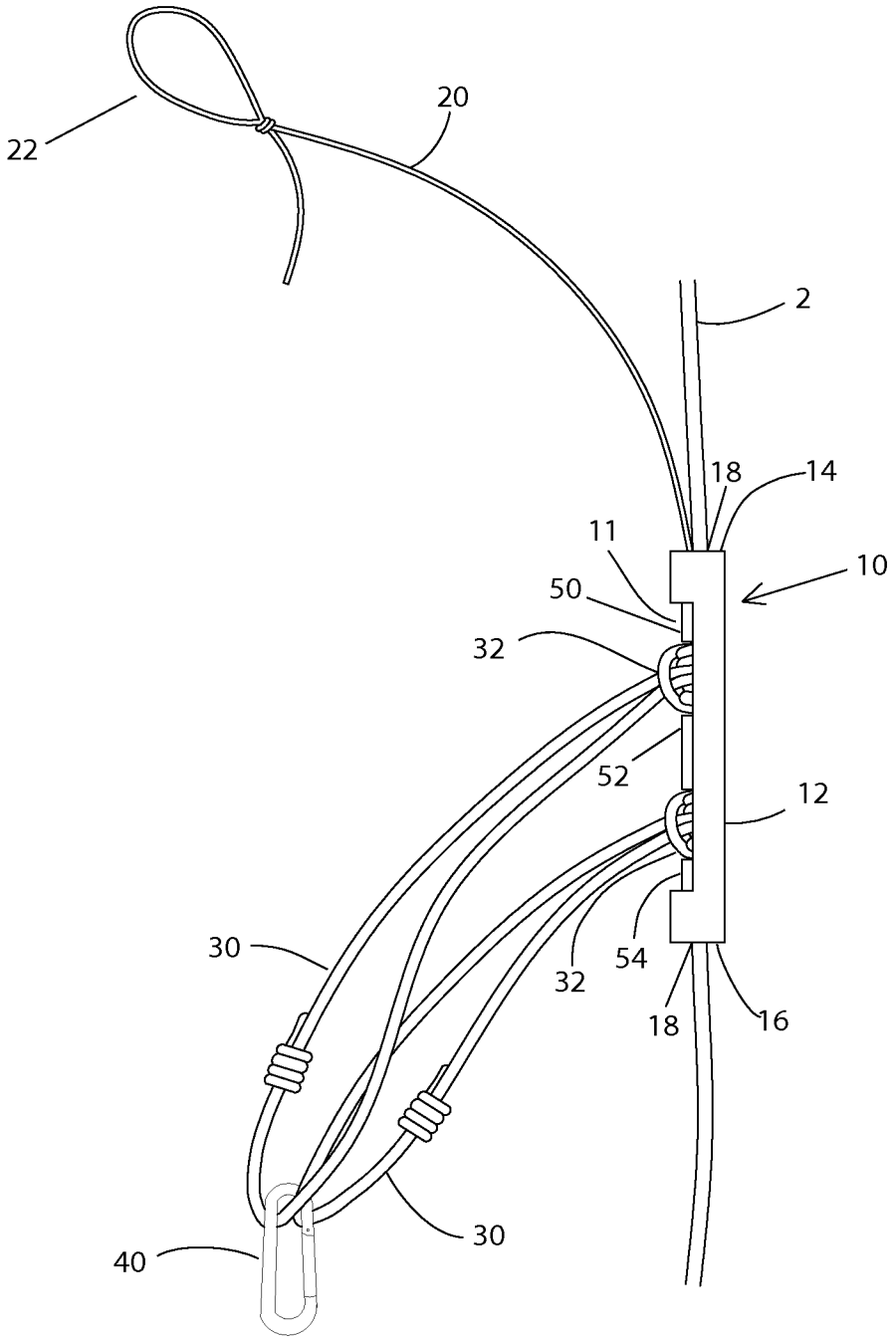
FIG. 1 is a side view of the fall restraint traveler device made according to the present invention shown assembled to a safety rope.

With reference to FIG. 1, the fall restraint traveler device made according to a preferred embodiment of the present invention is shown as illustrated in FIG. 1. In this preferred embodiment, as illustrated, two lanyards 30 as shown extending from the slot 11 in the body structure 12 of the device 10. The lanyards 30 as shown are wrapped about the safety rope 2. The safety rope 2 does not form part of the invention; however, is an integral part in its final intended use. The device 10 itself will be sold and manufactured separate of the safety rope 2 and therefore is not considered to be an element of the present invention; however, it is essential in the use of the present invention that the safety rope 2 be illustrated for purposes of explaining how the traveler device 10 works.

With reference to the lanyards 30, dual lanyards are used each having a locking element 32 wrapped about the safety rope 2 and extending from the slot 11 to a carabiner or other clasp mechanism 40. The clasp mechanism 40 is shown holding both lanyards 30 and this clasp 40 can then be attached to a safety harness or belt of the person climbing the ladder. Once secured by the clasp 40 and lanyards 30, the climber can safely climb up a ladder that has a safety rope 2 extending between the ends of the ladder and being held in taut alignment longitudinally up and down the length of the ladder preferably along one side of the ladder so that the climber's feet do not get entangled with any of the device 10 and or the safety rope 2.

As shown, the body structure 12 of the traveler device 10 has a first end 14 and an opposite second end 16. Each end 14, 16 has openings 18 allowing the rope 2 to pass between the ends through the length of the hollow body structure 12. As further shown, at the end 14 of the body structure 12 is a leash 20, the leash 20 is shown with a loop 22. This loop 22 which is knotted allows the climber to grasp it with his hand or thumb, and as he climbs, the leash is pulled in the direction of either climbing up or down. Under these circumstances, the entire device 10 is free to slide up and down the assembly. The leash 20 is affixed through a hole 17 by a knot.

Figure 2:
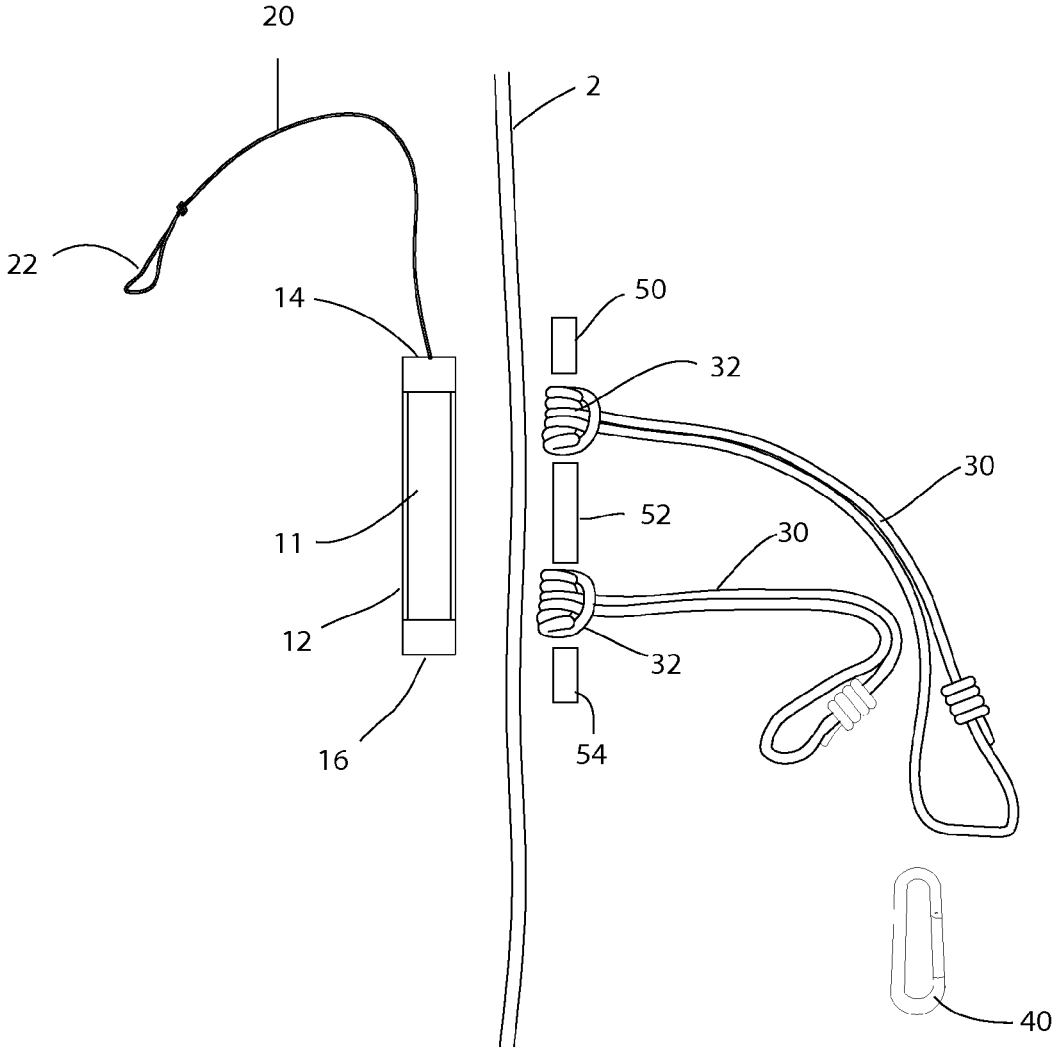
FIG. 2 is an exploded view of the fall restraint traveler device shown unassembled and detached from the safety rope.

As further illustrated in FIG. 2, internal of the body structure 12 of the device 10 are a plurality of spacers 50, 52 and 54. These spacers 50, 52 and 54 as shown in FIG. 1 fit into the slot 11 and are positioned between the locking elements 32 of each lanyard 30. As shown, the preferred embodiment employs two lanyards 30 each with a locking element 32. It is possible that only one lanyard 30 be employed in such a case only two spacers 50, 52 would be needed for the assembly. It is preferable to use two lanyards 30 as a dual tandem safety device such that in the event one lanyard 30 fails the other will pick up the slack and insure that the locking element 32 cinches securely to the rope 2. For a better appreciation of how the device 10 works, one must consider as a climber that is climbing up a ladder and is attached to the fall restraint traveler device 10 he pulls on the device 10 using his thumb as he climbs using the leash 20. The leash 20 pulls on the device 10 so that it slides freely up the rope 2 as the climber ascends. When climbing down the ladder, the climber simply pulls downwardly on the leash 20 as he descends. As this occurs the climber can freely ascend or descend a ladder while maintaining a secure attachment to a safety rope 2 as illustrated. It is important to note that should the climber fall, the lanyards 30 will pull on the rope 2 through the slot 11 in the body structure 12 and as the rope is pulled out of a straight line alignment, the locking elements 32 will cinch down on the rope 2 activating the locking feature of the device 10. As shown, the locking element 32 is a knot that is wrapped about the rope 2 in such a fashion that when pulled it will tighten onto the rope 2. The knot 32 as illustrated and shown as reference numeral 32 as best understood is a PRUSIK knot, more particularly a triple PRUSIK knot. These devices are known to provide secure cinching onto ropes and are commonly used in hoisting heavy equipment up and down ropes. The more you pull, the tighter the locking element 32 cinches onto the rope 2. The advantage of the present invention is that this cinching feature does not come into play when it is assembled into this device 10 because the spacers 50, 52 and 54 on the assembled device 10 have the rope 2 extending between the device 10 and through the spacers 50, 52 and 54 and through the locking elements 32 in such a fashion that as long as the rope 2 remains straight with the device 10 in alignment, there is no direct pulling of the lanyard 30 causing locking elements 32 to move out of alignment. As the spacers 50, 52 and 54 and body structure 12 are pulled by the leash 20, the spacers push on the knots 32, this causes knots 32 to remain in a relatively open position such that they freely slide up and down the rope. This remarkable feature allows the device 10 to be used without interfering with the ability to climb up and down the rope 2; however, should the climber fall or lose his footing the lanyards 30 will pull on the rope through the slot 11 and cause a misalignment of the rope 2. As this occurs the lanyards 30 are providing a force on the locking elements, the PRUSIK knots 32 as illustrated in such a fashion that they tighten. As they tighten onto the rope 2, the person held by the lanyard 30 will immediately stop his fall. This safety feature will greatly enhance the ability of those climbing aerial ladders to avoid a certain death when falling from extended heights. The advantage of this system is that it requires no mechanisms requiring complex electric or other associated mechanical complexities. The device 10 simply relies on the gripping ability of the PRUSIK knot on a rope 2 when pulled, but until pulled the knot is maintained open and loose free to slide by the device 10 construction. This ability will enable the system to work dependably and reliably throughout its life.

Figure 3:
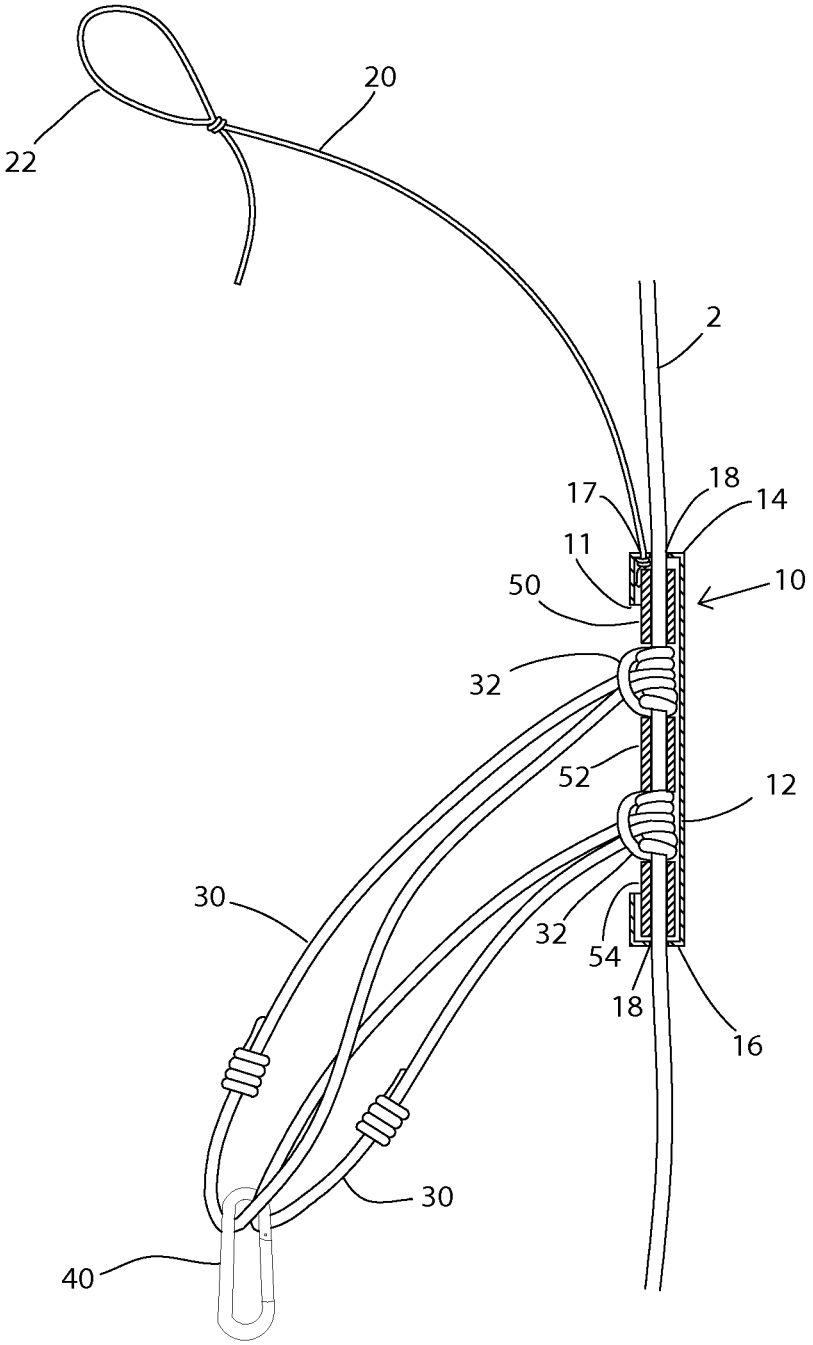
FIG. 3 is a cross sectional view of the device of FIG. 1.

FIG. 3 shows a cross sectional of the fall restraint traveler device 10 as shown taken from FIG. 1. In this cross sectional view the rope 2 is shown extending through an opening 18 at the end 14 and end 16 of the body structure 12. As further shown, a small hole 17 is provided through which the leash 20 has a knot tied thereby securing the leash 20 to the body structure 12. As further shown, the spacers 50, 52 and 54 are larger than the diameter of the opening 18 at both the first and second ends 14, 16 of the body structure 12. In this fashion the spacers 50 and 54 are retained inside the body structure 12 and the ends of the body structure 12 help push or pull the spacers 50, 52 and 54 helping to maintain the locking mechanisms 32 in an open fashion. This ability of the spacers 50, 52 and 54 to push on the locking mechanism 32 keeps the locking mechanisms 32 in a fully open position as long as the rope 2 remains in straight alignment with the device 10 and the lanyards 30 are not loaded as occurs during a fall.

As shown, it is believed important that the safety rope 2 be a static kernmantle rope preferably having a diameter of ½"/12.5 mm or greater and breaking strength of at least 9,000 lbs, a length of 75 to 150 feet or whatever length is needed for the full extension of the ladder. Typically these ladders extend 75 to 100 feet or more, sometimes 130 to 150 feet in length. It is preferred that the rope 2 be of sufficient length that it is able to accommodate whatever length of ladder is required. Not shown, the end of the rope 2 can have a carabiner or quick release mechanism or other attachment clasp or fastener attached so that the rope 2 can be attached to a top end of the ladder and be allowed to be affixed there. Once the ladder is refracted, this attachment or fastener can be unfastened in order to stow the safety rope 2.

Furthermore, as shown, the locking element 32 used on the lanyard 30 tying the climber to the safety rope 2 and attached to the climber through his waist belt or other harness can be any locking mechanism that allows free movement of the climber, but will lock onto the rope 2 in the event he should fall and a force be applied to the lanyard 30 such that it triggers the locking element 32 to clamp or cinch onto the rope 2 preventing further sliding downwardly.

The body structure 12 and the spacers 50, 52, 54 can be made of durable plastic or metal. The use of aluminum is ideal due to its light weight and corrosion resistance.

It is further noted that the lanyard 30 itself should preferably be a rope of sufficient strength to be able to support the weight of a falling climber.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described, which will be within the full intended scope of the invention as defined by the following appended claims.

What is claimed is:

1. A fall restraint traveler device for free-sliding attachment to a safety rope held taut between ends while affixed to a ladder or other climbing structure such as an extendable or telescoping ladder platform, the fall restraint traveler device comprises:

a hollow body structure having a first end and a second end, the safety rope extends passing through both first and second ends, the body structure having an elongated slot extending between the ends;

two or more tubular spacers placed internal of the body structure with the safety rope passing through each spacer;

one or more lanyards for attachment to a climber, the one or more lanyards each having at least one locking element, each locking element spaced between a pair of the spacers and wrapped about said rope, the lanyard extending through the elongated slot and attachable to the climber; and wherein the body structure with the spacers and the at least one locking element are aligned with and free to slide along the safety rope during ascent or descent of the climber and in the event of a fall, the at least one locking element pulls on the safety rope pulling the rope out of alignment and thereby cinching to the rope.

2. The fall restraint traveler device of claim 1 further comprises a leash attached to the body structure, the leash being attachable or to be held by the climber.

3. The fall restraint traveler device of claim 1 comprises two lanyards.

4. The fall restraint traveler device of claim 3 comprises three spacers.

5. The fall restraint traveler device of claim 1 wherein the one or more lanyards is a rope.

6. The fall restraint traveler device of claim 5 wherein the at least one locking element is a knot adapted to remain open until pulled.

7. The fall restraint traveler device of claim 6 wherein the knot is a PRUSIK knot.

8. The fall restraint traveler device of claim 7 wherein the PRUSIK knot is a triple wrapped PRUSIK knot.

9. The fall restraint traveler device of claim 1 wherein the body structure is metal.

10. The fall restraint traveler device of claim 9 wherein the body structure is aluminum.

11. The fall restraint traveler device of claim 1 wherein the body structure is plastic.

12. The fall restraint traveler device of claim 1 wherein the spacers are metal.

13. The fall restraint traveler device of claim 12 wherein the spacers are aluminum.

14. The fall restraint traveler device of claim 1 wherein the spacers are plastic.

* * * * *